US008062188B1

(12) United States Patent
Chien

(10) Patent No.: US 8,062,188 B1
(45) Date of Patent: Nov. 22, 2011

(54) ELLIPTICAL EXERCISE MACHINE

(75) Inventor: A-Liang Chien, Taichung (TW)

(73) Assignee: Strength Master Fitness Tech Co., Ltd., Taichung (TW)

( * ) Notice: Subject to any disclaimer, the term of this patent is extended or adjusted under 35 U.S.C. 154(b) by 0 days.

(21) Appl. No.: 13/069,557

(22) Filed: Mar. 23, 2011

Related U.S. Application Data

(63) Continuation-in-part of application No. 12/778,444, filed on May 12, 2010, now Pat. No. 7,985,165.

(51) Int. Cl.
*A63B 22/04* (2006.01)

(52) U.S. Cl. ..... 482/52; 482/51

(58) Field of Classification Search ..... 482/51–53, 482/57, 70, 79–80
See application file for complete search history.

(56) References Cited

U.S. PATENT DOCUMENTS

| | | | | |
|---|---|---|---|---|
| 4,850,245 | A * | 7/1989 | Feamster et al. | 74/594.1 |
| 4,973,046 | A * | 11/1990 | Maxwell | 482/60 |
| 5,161,430 | A * | 11/1992 | Febey | 74/594.7 |
| 5,242,343 | A * | 9/1993 | Miller | 482/57 |
| 5,566,589 | A * | 10/1996 | Buck | 74/594.1 |
| 5,685,804 | A * | 11/1997 | Whan-Tong et al. | 482/51 |
| 5,924,962 | A * | 7/1999 | Rodgers, Jr. | 482/57 |
| 6,168,552 | B1 * | 1/2001 | Eschenbach | 482/52 |
| 6,361,476 | B1 * | 3/2002 | Eschenbach | 482/52 |
| 6,440,042 | B2 * | 8/2002 | Eschenbach | 482/52 |
| 6,846,273 | B1 * | 1/2005 | Stearns et al. | 482/52 |
| 7,060,005 | B2 * | 6/2006 | Carlsen et al. | 482/52 |
| 7,267,638 | B2 * | 9/2007 | Wang | 482/52 |
| 7,278,955 | B2 * | 10/2007 | Giannelli et al. | 482/51 |
| 7,438,671 | B2 * | 10/2008 | Wang | 482/52 |
| 7,611,446 | B2 * | 11/2009 | Chuang et al. | 482/52 |
| 7,618,351 | B2 * | 11/2009 | Kwon et al. | 482/52 |
| 7,670,267 | B2 * | 3/2010 | Wang | 482/52 |
| 7,682,289 | B2 * | 3/2010 | Chen | 482/51 |
| 7,740,564 | B2 * | 6/2010 | Shen | 482/52 |
| 7,794,361 | B2 * | 9/2010 | Wang | 482/51 |
| 7,985,165 | B1 * | 7/2011 | Lin et al. | 482/52 |
| 2007/0238580 | A1 * | 10/2007 | Wang | 482/52 |
| 2009/0011904 | A1 * | 1/2009 | Chuang et al. | 482/52 |
| 2009/0054212 | A1 * | 2/2009 | Wang | 482/52 |
| 2009/0124463 | A1 * | 5/2009 | Chen | 482/52 |

* cited by examiner

*Primary Examiner* — Stephen Crow
(74) *Attorney, Agent, or Firm* — Rosenberg, Klien & Lee

(57) ABSTRACT

An elliptical exercise machine includes a bottom frame, two transmission bars, and two stepping bars. The bottom frame has a rotating axis, both sides of which are provided with a crank, respectively. One end of each of the two transmission bars is connected with the corresponding crank. The two stepping bars are connected with the two transmission bars. The other end of each of the stepping bars has a dragging mechanism mounted on the bottom frame. Driven by the two swing arms and the two transmission bars, the two stepping bars perform elliptical motions. Before the two stepping bars move to the left and right extremities of the elliptical curve, the corresponding dragging mechanism is driven to produce a quick return action. The two dragging mechanisms also simultaneously perform reciprocal dragging motions to correct the elliptical motions of the stepping bars and make the motions smoother.

8 Claims, 9 Drawing Sheets

ELLIPTICAL EXERCISE MACHINE

CROSS-REFERENCE TO RELATED APPLICATION

This application is a Continuation-In-Part Application of Ser. No. 12/778,444, filed May 12, 2010, and entitled "Elliptical exercise machine", now pending.

BACKGROUND OF THE INVENTION

1. Field of Invention

The invention relates to fitness equipment and, in particular, to an elliptical exercise machine in accord with human factors engineering.

2. Related Art

The conventional elliptical machine design, as shown in FIG. 9, has a frame 91 whose front end extends upward with a vertical bar 92. Both sides of the vertical bar 92 are pivotally installed with two swing arms 93. The rear end of the frame 91 is mounted with a driving wheel 94. Both sides of the driving wheel 94 are disposed with a crank 95, respectively. Both sides of the frame 91 are installed with a stepping bar 96, respectively. The two stepping bars 96 are fixed with a stepping board 97, respectively. The two stepping bars 96 are pivotally connected to the ends of the two swing arms 93 by their front ends. The rear ends of the two stepping bars 96 are connected to the two cranks 95, respectively. The front end of the stepping bar 96 is dragged by the swing arm 93 to perform a reciprocal motion along an arc curve. The rear end of the stepping bar 96 is dragged by the crank 95 to move along a circular curve. Therefore, the stepping boards 97 on the two stepping bars 96 can move along an elliptical curve.

In order for the elliptical machine to fit users of different sizes, one often has to adjust the length of the crank 95, thereby satisfying the different footstep spans. However, the conventional elliptical machine design fixes the stepping boards 97 on the stepping bars 96, and the two stepping bars 96 are directly connected with the swing arms 93 and the crank 95. Therefore, the higher the steps and the larger the footstep span, the angle of the stepping boards during the exercise is also larger. This affects the comfort and the force exerted on the joints of the user. This is because the design does not fit human factors engineering.

Moreover, the conventional elliptical machine has elliptical curves. When the motion reaches the left and right extremities, the tangential speed has the largest change. Therefore, the user may experience frustration when the two stepping boards 97 move to the extremities of the elliptical curves.

SUMMARY OF THE INVENTION

An objective of the invention is to provide an elliptical exercise machine that does not change the tilt angle of the pedals according to the height and span of footsteps. This fits better with human factors engineering.

Another objective of the invention is to provide an elliptical exercise machine which has a dragging mechanism to lead the elliptical motion when it reaches the left and right extremities of the elliptical path. This can significantly improve the frustration feeling of the user, making the elliptical motion smoother.

A third objective of the invention is to provide an elliptical exercise machine that can change the tilt angle of the major axis of the elliptical path, thereby simulating inclined motions.

To achieve the above-mentioned objectives, the disclosed elliptical exercise machine includes: a bottom frame, two swing arms, two transmission bars, a dragging mechanism, and two stepping bars.

One end of the bottom frame has a vertical bar. The end opposite to the vertical bar further extends upward with a first support. The first support has a rotating axis whose both ends have a crank, respectively.

The two swing arms are pivotally connected to the left and right sides of the vertical bar. The ends of the swing arms are formed with connecting parts that can swing back and forth relative to the vertical bar.

One end of the transmission bar is connected with the corresponding crank. The other end is connected with the connecting part of the corresponding swing arm. Moreover, the transmission bar is formed with a pivotal part near the swing arm.

The dragging mechanism is mounted on the bottom frame. The two stepping bars are pivotally installed on the pivotal parts of the transmission bars with one end, respectively. The other end of each of the stepping bars is a dragging end. The dragging end has a pivotal element to connect to the dragging mechanism. During the dragging process, the stepping bars simultaneously perform reciprocal motions of rotations and move. As a user steps on the stepping bars, the transmission bars drive the cranks to rotate. Driven by the swing arms and the transmission bars, the stepping bars perform elliptical motions.

BRIEF DESCRIPTION OF THE DRAWINGS

These and other features, aspects and advantages of the invention will become apparent by reference to the following description and accompanying drawings which are given by way of illustration only, and thus are not limitative of the invention, and wherein.

DETAILED DESCRIPTION OF THE INVENTION

The present invention will be apparent from the following detailed description, which proceeds with reference to the accompanying drawings, wherein the same references relate to the same elements.

Figure 1:
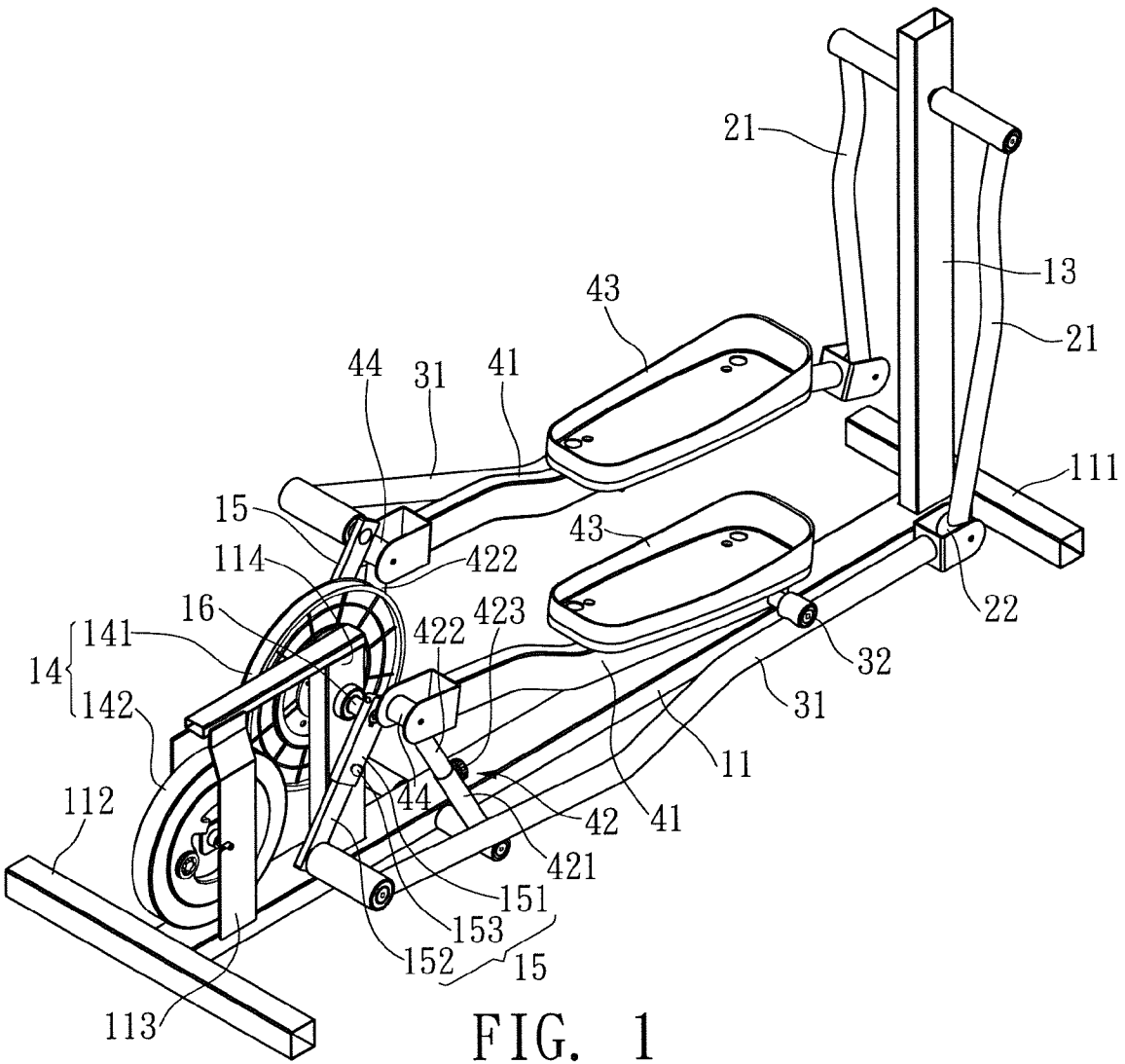
FIG. 1 is a perspective view of the first embodiment of the invention.
Figure 2:
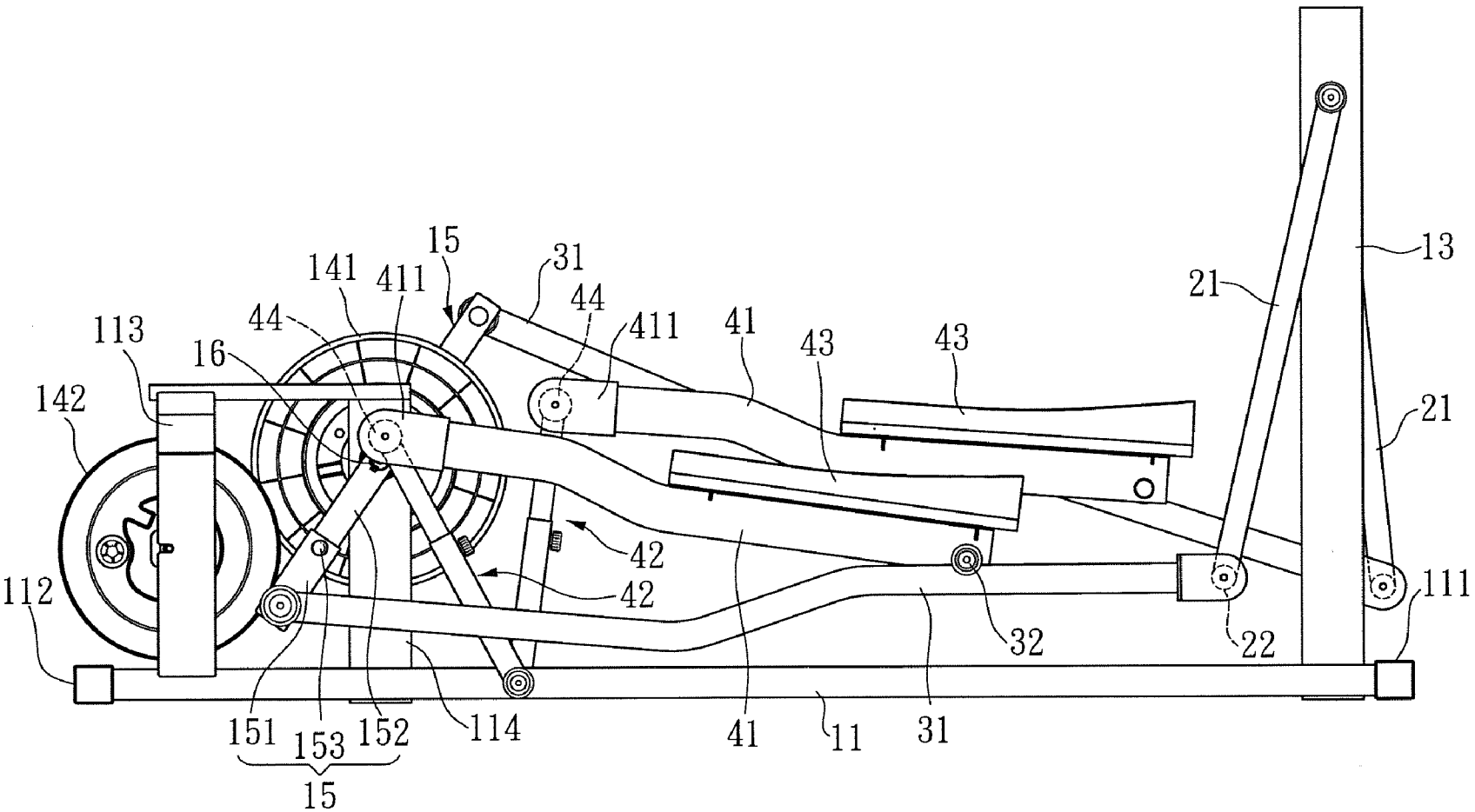
FIG. 2 is a planar structural view of the first embodiment of the invention.

Please refer to FIGS. 1 and 2, which show a first embodiment of the disclosed elliptical exercise machine. The machine mainly consists of a bottom frame 11, two swing arms 21, two transmission bars 31, and two stepping bars 41.

The bottom frame 11 can be disposed on the ground stably. The bottom frame 11 has a front end 111 and a rear end 112. The front end 111 of the bottom frame 11 is installed with a vertical bar 13 extending upward. The rear end 112 is extended upward with a first support 114 and a second support 113. The first support 114 has a rotation axis 16 horizontally through it, protruding from the left and right sides of the first support 114. Both ends of the rotation axis 16 have a crank 15, respectively. There is a resistance mechanism 14 that includes a driving wheel 141 and a resistance wheel 142 connecting to the driving wheel 141 and providing resistance. The driving wheel 141 is mounted on the rotation axis 16 by its axis. The resistance wheel 142 is mounted on the second support 113.

The two swing arms 21 are pivotally connected to the left and right sides of the vertical bar 13 by their one end, respectively. The other ends of the two swing arms 21 extend downward and form respectively a connecting part 22 that can swing back and forth with respect to the vertical bar 13.

The two transmission bars 31 are pivotally connected to the two cranks 15 by their one end, respectively. Their other ends are pivotally connected with the connecting parts 22 of the two swing arms 21, respectively. A pivotal connecting part 32 is formed on the two transmission bars 31 near the two swing arms 21, respectively.

The two stepping bars 41 are pivotally connected to the pivotal connecting parts 32 of the corresponding transmission bars 31. The other end of each of the stepping bars 41 is a dragging end 411. Each of the dragging ends 411 has a pivotal rotation element 44 to connect to a dragging bar 42 pivotally. Each of the dragging bars 42 is pivotally connected downward to the bottom frame 11 near the resistance mechanism 14. The top surface of each of the stepping bars 41 is fixed with a pedal 43. Each of the dragging bars 42 consists of an outer tube 421 and an inner tube 422 mounted together. Each of the outer tubes 421 is provided with a positioning element 423 that fixes the position of the inner tube 422 relative to the outer tube 421. This configuration enables one to change the tilt angle of the stepping bar 41 by adjusting the length of the dragging bar 42. The tilt angle of the major axis of the elliptical path is thus modified to simulate the uphill and downhill motions.

Figure 3:
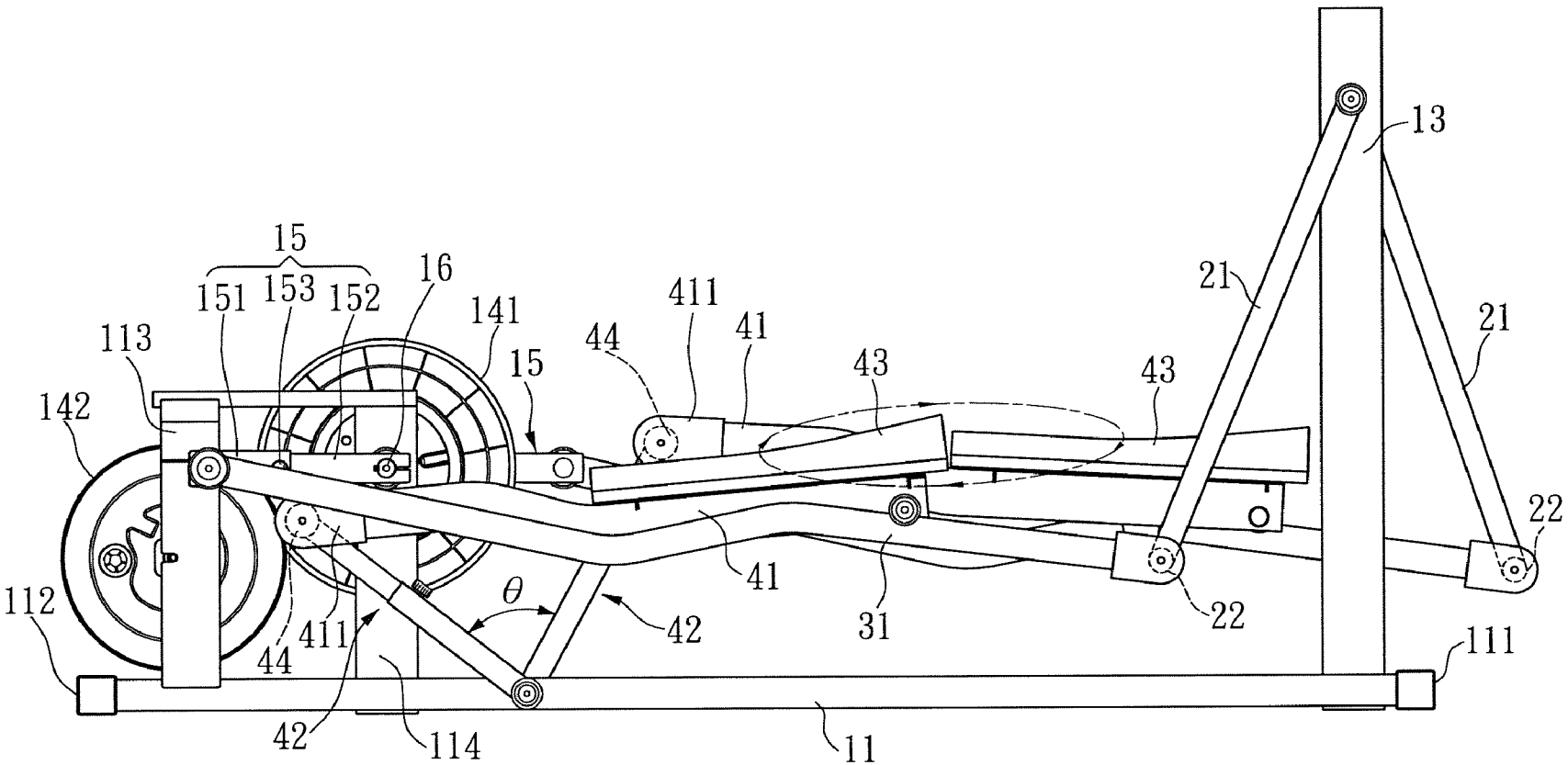
FIG. 3 shows the usage of the first embodiment, as the elliptical motion of the invention reaches its left and right extremities.

According to the above description, FIG. 3 shows how the first embodiment operates. By stepping the pedals 43 of the two stepping bars 41, the two transmission bars 31 drive the two cranks 15 to rotate around the rotation axis 16 and lead the swing arms 21 to swing back and forth simulataneously with respect to the vertical bar 13. In this manner, the pedals 43 perform elliptical motions. The two dragging bars 42 perform reciprocal dragging motions within a dragging angle θ no greater than 180 degrees, as the two stepping bars undergo the elliptical motions. So as the feet of the user perform elliptical motions, the upward or downward motion of the pedals 43 on the stepping bars 41 are led by the dragging bars 42 to mimic actual walking of the human body.

Moreover, the crank 15 in this embodiment consists of an outer tube 151 and an inner tube 152 linked together. A positioning element 153 is employed to adjust the length of the crank 15, thereby changing the stride height and length as the user performs the elliptical motion. Since the pedals 43 are disposed on the stepping bars 41 and the stepping bars 41 are pivotally connected to the dragging bars 42, the tilt angle of the transmission bars 31 changes as the length of the cranks 15 varies. Nevertheless, as the transmission bars 31 and the stepping bars 41 are pivotally connected via the pivotal connecting part 32, the tilt angle of the stepping bars 41 is not affected even when the tilt angle of the transmission bars 31 changes. Therefore, the stepping bars 41 are restricted to perform the reciprocal swing actions at the same predetermined angle. The tilt angle of the pedals 43 does not change with different stride heights and lengths. This is more compliant with human factors engineering.

When this embodiment performs the elliptical motion, the pivotal rotation element 44 of the stepping bar 41 drives the dragging bar 42 to perform a reciprocal dragging motion. When the two stepping bars 41 move to the left and right extremities of the elliptical path, the reciprocal dragging motion of the dragging bars 42 generates an inertial quick return effect on the two stepping bars 41. This mechanism improves user's frustrating feeling when the pedals 43 move to the two extremities of the elliptical path, making the elliptical exercise machine run smoother.

Figure 4:
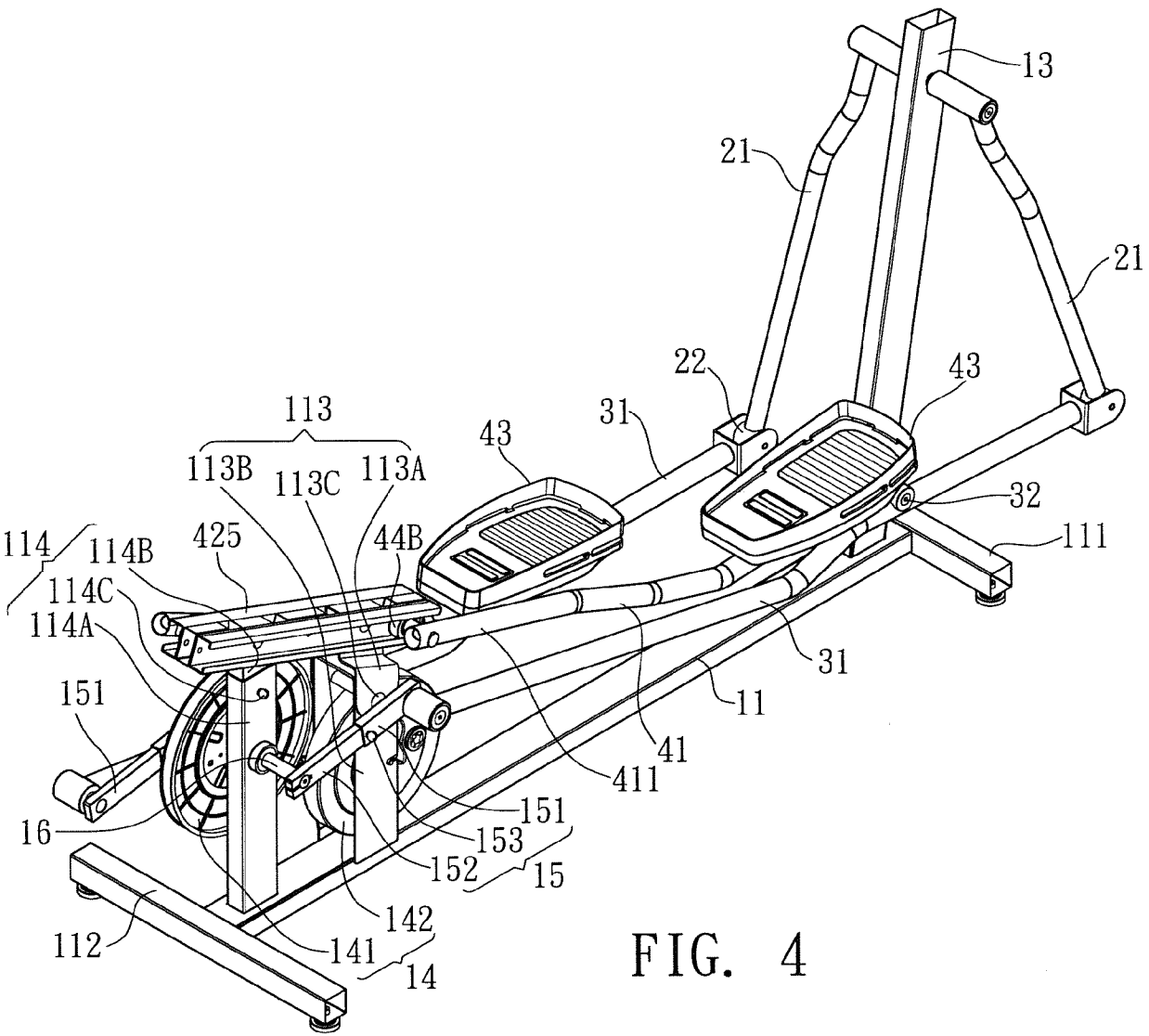
FIG. 4 is a perspective view of the second embodiment of the invention.
Figure 5:
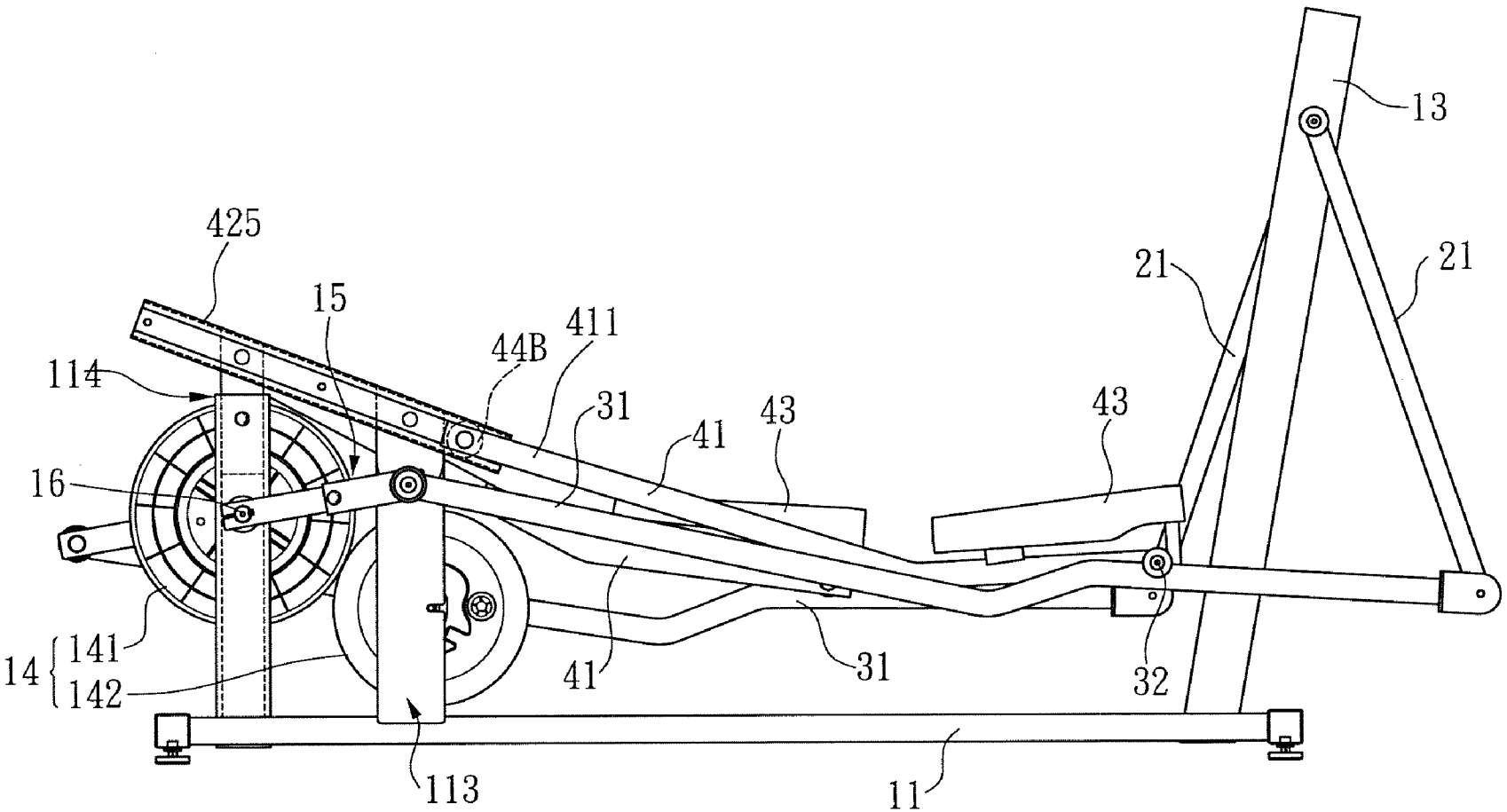
FIG. 5 is a planar structural view of the second embodiment of the invention.

Please refer to FIGS. 4 and 5 for a second embodiment of the invention. This embodiment differs from the first embodiment in that a sliding rail 425 and a pivotal rotation element 44B replace the dragging bar 42 and pivotal rotation element 44. The sliding rail 425 is pivotally mounted on the first support 114 and the second support 113 of the bottom frame 11, above the frictional mechanism 14. The sliding rail 425 tilts and extends downward toward the end of the bottom frame 11 with the vertical bar 13. One side of the pivotal rotation element 44B slides on the sliding rail 425, whereas the other side is pivotally connected to the stepping bar 41.

When a user steps on the pedals 43, they drive the transmission bars 31 to rotate the cranks 15 with respect to each other. At the same time, the stepping bars 41 are driven into motion. With the effect of the pivotal rotation element 44B, the pivotal rotation element 44B of the stepping bar 41 performs a dragging motion having two degrees of freedom in moving and rotating on the corresponding sliding rail 425 to lead the pedal 43 to form a corresponding elliptical motion. When the two stepping bars 41 move to the left and right extremities of the elliptical path, inertia of the reciprocal sliding leads the stepping bars 41 to produce a quick return effect. This mechanism improves user's frustrating feeling when the pedals 43 move to the two extremities of the elliptical path, making the elliptical exercise machine run smoother.

Figure 6:
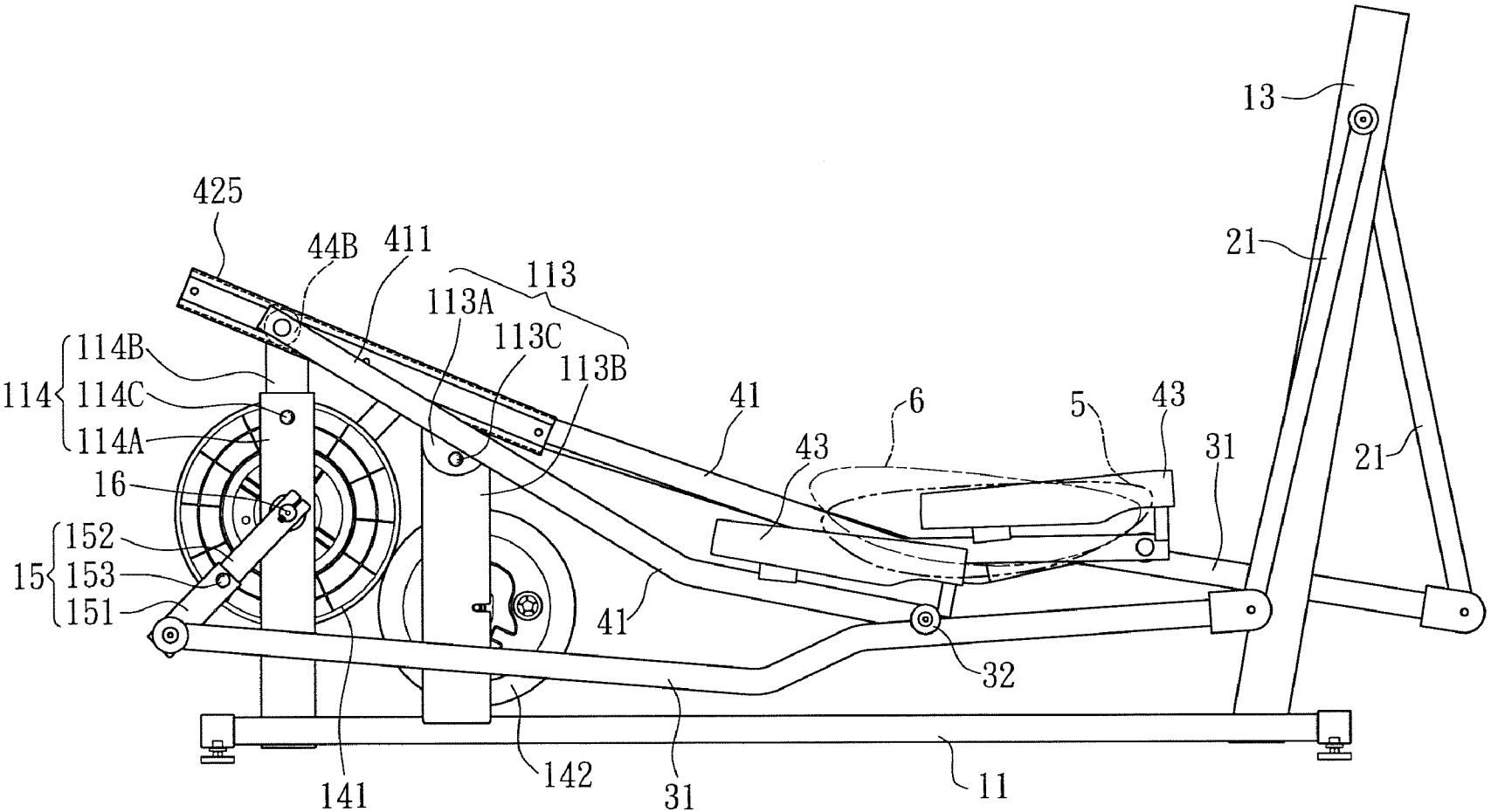
FIG. 6 shows that in the second embodiment, the length of the first support or second support is adjusted to increase the inclination angle of the sliding rail, with the changed elliptical curve also indicated.

Moreover, in this embodiment, the first support 114, the second support 113, and the two cranks 15 consist of respectively an outer tube 114A, 113A, 151 and an inner tube 114B, 113B, 152 linked together. A positioning element 114C, 113C, 153 is provided on the outer tube 114A, 113A, 151 to position the corresponding inner tube 114B, 113B, 152, respectively. By changing the relative position between the inner and outer tubes, one can adjust the lengths of the first support 114, the second support 113, and the two cranks 15. The length adjustment of each of the above-mentioned components has three schemes. One is shown in FIG. 6. The length of the first support 114 or the second support 113 is adjusted to increase the inclination angle of the sliding rail 425 relative to the horizontal plane. The elliptical path 6 formed by the pedal 43 tilts toward the front in comparison with the elliptical path 5 before the adjustment, simulating a downhill motion.

Figure 7:
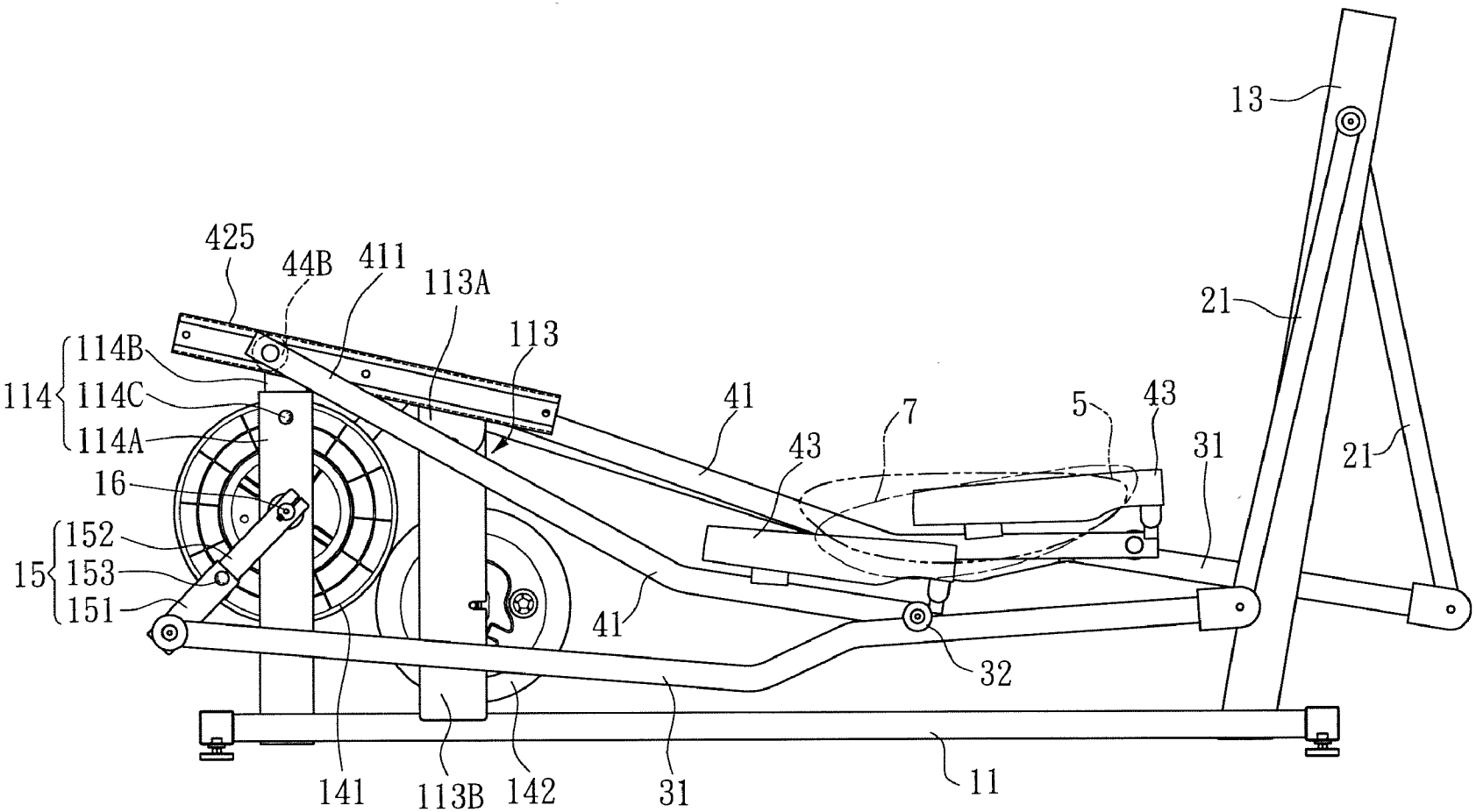
FIG. 7 shows that in the second embodiment, the length of the first support or second support is adjusted to reduce the inclination angle of the sliding rail, with the changed elliptical curve also indicated.

The second scheme is shown in FIG. 7. The length of the first support 114 or the second support 113 is adjusted to reduce the inclination angle of the sliding rail 425 relative to the horizontal plane. The elliptical path 7 formed by the pedal 43 tilts toward the back in comparison with the elliptical path 5 before the adjustment, simulating an uphill motion.

Figure 8:
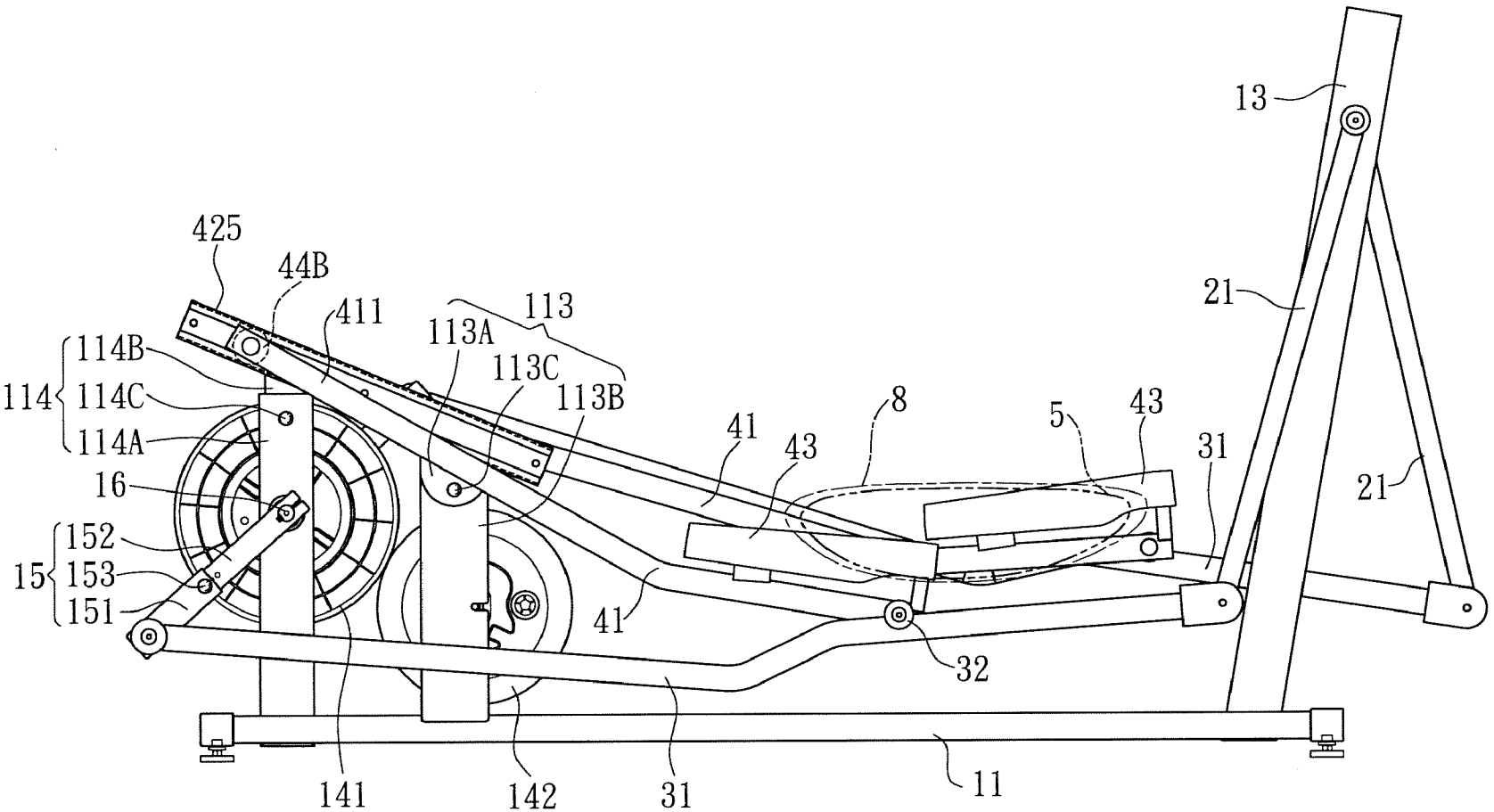
FIG. 8 shows how the elliptical curve is changed as one adjust the length of the crank in the second embodiment.
Figure 9:
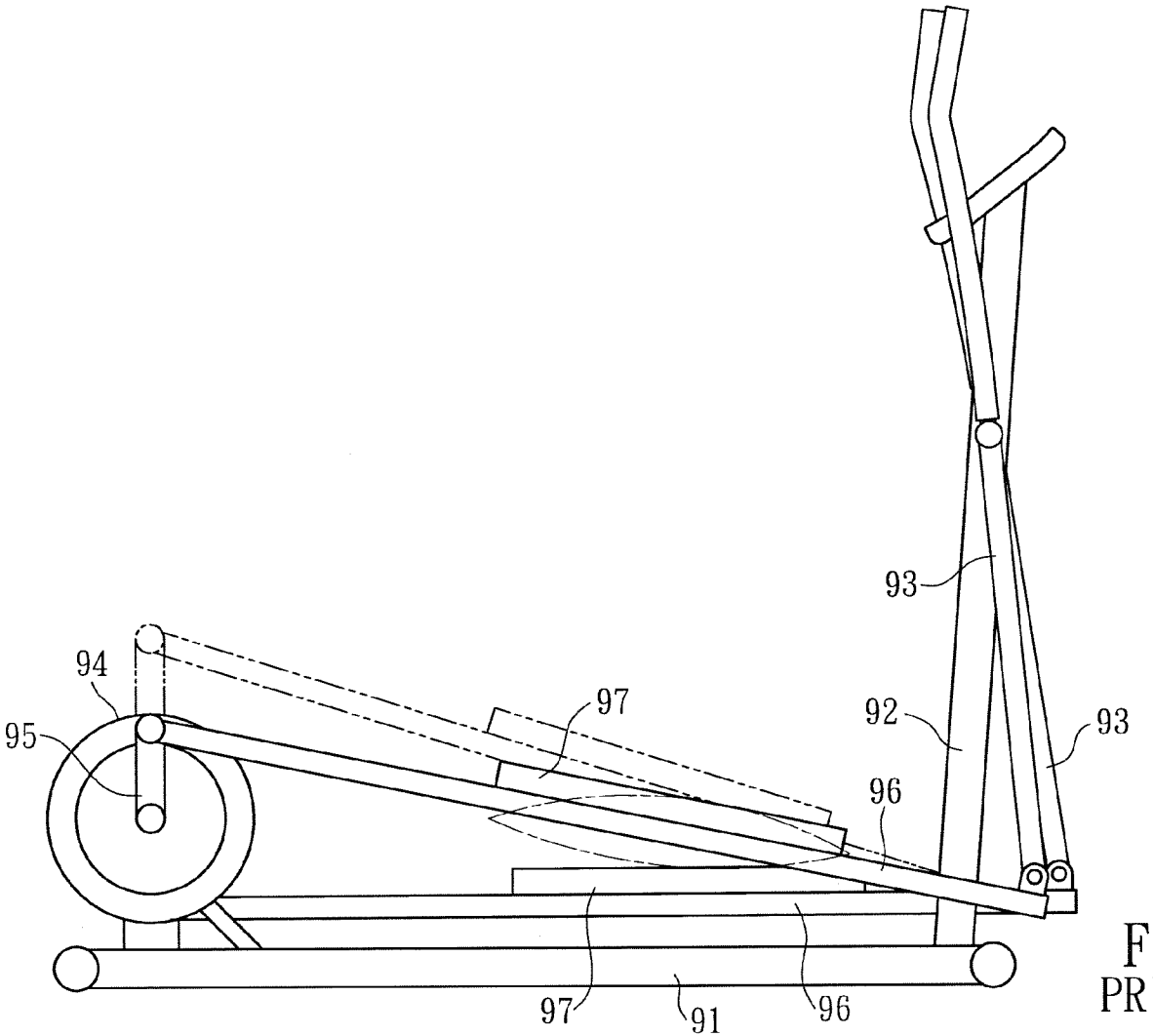
FIG. 9 PRIOR ART
FIG. 9 is a schematic view of a conventional elliptical machine.

Finally, the third scheme is shown in FIG. 8. By adjusting the length of the crank 15, one can change the distance between the left and right extremities of the elliptical path of the pedal 43. Therefore, the stride length and stride height are both increased. The elliptical path 8 formed by the pedal 43 is scaled up from the elliptical path 5 before the adjustment.

The above-mentioned three schemes all modify the elliptical path of the pedal 43 by adjusting the lengths of the first support 114, the second support 113, and the two cranks 15. They simulate various running states and suit users of different builds, compliant with human factors engineering.

Although the invention has been described with reference to specific embodiments, this description is not meant to be construed in a limiting sense. Various modifications of the disclosed embodiments, as well as alternative embodiments, will be apparent to people skilled in the art. Therefore, it is contemplated that the appended claims will cover all modifications that fall within the true scope of the invention.

What is claimed is:

1. An elliptical exercise machine, comprising:

a bottom frame, with a vertical bar provided on one end and a first support provided on another end opposite to the vertical bar, the first support having a rotating axis with a crank on each of the two ends thereof;

two swing arms pivotally connected to the vertical bar, the end of the swing arms being formed with a connecting part that swings back and forth relative to the vertical bar;

two transmission bars, each of which connects to the corresponding crank at one end and to the connecting part of the corresponding swing arm at the other end, with a pivotal connecting part formed thereon near the corresponding swing arm;

a longitudinally extended sliding rail mounted on the bottom frame;

two stepping bars, each of which is pivotally connected to the pivotal connecting part of the corresponding transmission bar at one end and functions as a dragging end on the other end, the dragging end being provided with a pivotal rotation element to connect to the sliding rail and being longitudinally displaceable therein; and two pedals, each of which is mounted on a respective one of the stepping bars;

wherein the stepping bars simultaneously perform reciprocal rotating and moving motions, the stepping bars drive the transmission bars to rotate the cranks and the swing arms to swing, so that the pedals perform an elliptical motion.

2. The elliptical exercise machine of claim 1, wherein the sliding rail pivotally is installed on the first support and tilts downwardly toward the vertical bar, and the pivotal rotation element of the dragging end of the stepping bar is connected with the sliding rail so that the pivotal rotation element performs a dragging motion with reciprocal movement and rotation along the sliding rail.

3. The elliptical exercise machine of claim 1, wherein the bottom frame further has a second support.

4. The elliptical exercise machine of claim 1, wherein the first support consists of an outer tube and an inner tube linked together, and a positioning element is provided on the outer tube to fix the position of the inner tube relative to the outer tube, thereby adjusting the length thereof.

5. The elliptical exercise machine of claim 3, wherein the second support consists of an outer tube and an inner tube linked together, and a positioning element is provided on the outer tube to fix the position of the inner tube relative to the outer tube, thereby adjusting the length thereof.

6. The elliptical exercise machine of claim 3, wherein the first support and the second support consist of an outer tube and an inner tube linked together, respectively, a positioning element is provided on each of the outer tubes to fix the position of the corresponding inner tube relative to the outer tube, thereby adjusting the lengths thereof.

7. The elliptical exercise machine of claim 1, wherein the crank consists of an outer tube and an inner tube linked together and a positioning element is employed to adjust the length thereof.

8. An elliptical exercise machine, comprising:

a bottom frame, with a vertical bar provided on one end and a first support provided on another end opposite to the vertical bar, the first support having a rotating axis with a crank on each of the two ends thereof;

two swing arms pivotally connected to the vertical bar, the end of the swing arms being formed with a connecting part that swings back and forth relative to the vertical bar;

two transmission bars, each of which connects to the corresponding crank at one end and to the connecting part of the corresponding swing arm at the other end, with a pivotal connecting part formed thereon near the corresponding swing arm;

a dragging mechanism mounted on the bottom frame, the dragging mechanism including a sliding rail pivotally installed on the first support and tilting downward toward the vertical bar;

two stepping bars, each of which is pivotally connected to the pivotal connecting part of the corresponding transmission bar at one end and functions as a dragging end on the other end, the dragging end being provided with a pivotal rotation element to connect to the dragging mechanism, the pivotal rotation element of the dragging end of each stepping bar being connected with the sliding rail so that the pivotal rotation element performs a dragging motion with reciprocal movement and rotation along the sliding rail; and two pedals, each of which is mounted on a respective one of the stepping bars;

wherein the stepping bars simultaneously perform reciprocal rotating and moving motions, the stepping bars drive the transmission bars to rotate the cranks and the swing arms to swing, so that the pedals perform an elliptical motion.

* * * * *